US007182321B2

(12) United States Patent
Huang et al.

(10) Patent No.: US 7,182,321 B2
(45) Date of Patent: Feb. 27, 2007

(54) SAFETY DEVICE FOR A HUMIDIFIER

(76) Inventors: Chuan-Pan Huang, No. 17, Hsinjen Rd., Tainan City (TW); Chen-Lung Huang, No. 17, Hsinjen Rd., Tainan City (TW)

( * ) Notice: Subject to any disclaimer, the term of this patent is extended or adjusted under 35 U.S.C. 154(b) by 181 days.

(21) Appl. No.: 11/004,537

(22) Filed: Dec. 2, 2004

(65) Prior Publication Data

US 2006/0118977 A1 Jun. 8, 2006

(51) Int. Cl.
*B01F 3/04* (2006.01)

(52) U.S. Cl. ..... 261/66; 261/72.1

(58) Field of Classification Search ..... 261/66, 261/72.1, 73, 81, 131, 142
See application file for complete search history.

(56) References Cited

U.S. PATENT DOCUMENTS 4,098,853 A * 7/1978 Brown et al. ..... 261/122.1
4,563,313 A * 1/1986 Tsuaki ..... 261/81
4,752,423 A * 6/1988 Wong ..... 261/142
4,820,453 A * 4/1989 Huang ..... 261/26
6,116,029 A * 9/2000 Krawec ..... 62/3.3
6,244,576 B1 * 6/2001 Tsai ..... 261/141
6,259,860 B1 * 7/2001 Chen-Lung et al. ..... 392/403
6,335,517 B1 * 1/2002 Chauviaux et al. ..... 219/628
6,394,427 B1 * 5/2002 Guetersloh et al. ..... 261/70
2004/0108604 A1 * 6/2004 Pan et al. ..... 261/26
2004/0234254 A1 * 11/2004 Czupich et al. ..... 392/403

FOREIGN PATENT DOCUMENTS

TW 145330 (79200515) 1/1990
TW 367023 8/1999

* cited by examiner

*Primary Examiner*—Scott Bushey
(74) *Attorney, Agent, or Firm*—J.C. Patents

(57) ABSTRACT

The present invention is directed to control method for supplying water in a humidifier. In a conventional humidifier, when the water level in the base of the humidifier is lowered to the ON/OFF critical region, with the vibration of the water level, the floating ball in the base will make ten's or hundred's times of ON/OFF vibrations, which tends to damage the high frequency vibration circuit. In addition, when the humidifier is inclined, the magnet on the floating ball remains in the attractive state with the magnetic spring switch that may cause fire of the electrical wires and leakage of the electricity. In the present invention, the floating ball is directly placed within a water tank, so that the magnetic spring switch can be effectively driven to conduct the ON/OFF movement, and the power can be cut off immediately when the water level of the water tank is lowered to the minimum level. When the humidifier is turned over by external force, the water tank will become separated from the base of the humidifier, which will break the contact between the floating ball and the magnetic spring switch so as to cut off the power, assuring the safety and extending the use time of the humidifier.

10 Claims, 6 Drawing Sheets

SAFETY DEVICE FOR A HUMIDIFIER

FIELD OF THE INVENTION

This invention relates to a safety device for a humidifier, particularly to one disposed between a body, a water tank, and a vapor tank and provided with a water level sensor, for sensing the water level in the water tank and cutting off power in due time, upgrading the safety of a humidifier.

BACKGROUND OF THE INVENTION

A conventional humidifier disclosed in a Taiwan patent No. 367023 is a first known one, which includes two sensors directly arranged in a water tank for checking the water level. Its major disadvantage is that the sensor may give out a wrong signal in case of the water tank still having some water if the humidifier is inclined, and cannot cut off power in due time, causing danger to a user.

Another Taiwan patent No. 145330 disclosed a humidifier, a second known one that includes a water chamber in the bottom base, a magnetic switch fixed in the water chamber, a float provided in a water tank and having a magnet to correspond to the magnetic switch. When the water level in the water tank falls down, the magnet may actuate the magnetic switch to turn off power. Then this second conventional humidifier has the same disadvantage as the first one.

Another humidifier disclosed in a U.S. Pat. No. 6,259,860B1 is invented by the same applicant of this case, a third conventional humidifier that has a water tank with an outlet, which has a water groove, and a float disposed around a connective rod of a water stopper. Then the float actuates a water level sensor fixed in a base of a body for sensing the water level. This third conventional humidifier has a disadvantage that some water still remains in the water tank in case of the humidifier is inclined improperly, and a humidifier in the invention does not have this drawback.

One more conventional humidifier disclosed in a U.S. Pat. No. 4,563,313 has a float disposed in a water tank, having the same disadvantage as those described above.

Further, another disadvantage in those conventional humidifiers is too much water in the water tank, so it takes too long time for boiling by the heater for producing vapor.

SUMMARY OF THE INVENTION

One purpose of the invention is to offer a safety device for a humidifier, making it possible to cut off the power immediately in case of the water level being lowered to a dangerous condition, and preventing improper sensing of the water level.

Another purpose is to offer a safety device for a humidifier possible to keep the lowest water level in a vaporizing chamber for quickly producing vapor.

The invention has the following features.

1. The safety device for a humidifier is positioned between a body, a water tank and a vapor tank, controlling an outlet for vapor and the water level in a vaporizing chamber to quickly produce vapor.

2. The safety device has a water level sensor located under the safety device and having a float and a sensor, so the float actuates the sensor to cut off power in due time to protect the safety of a humidifier. The sensor may be a magnetic member, or optical electric member.

3. The safety device has a film heater or an oscillator fixed in the bottom of the vaporizing chamber, with its vapor producing efficiency being high, not occupying much space and reducing partial dimensions of a humidifier.

The safety device has a safety sensor in the vaporizing chamber, so when the vapor tank is taken off the body, the safety sensor senses it and cuts off the power immediately, upgrading the safety of the humidifier.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
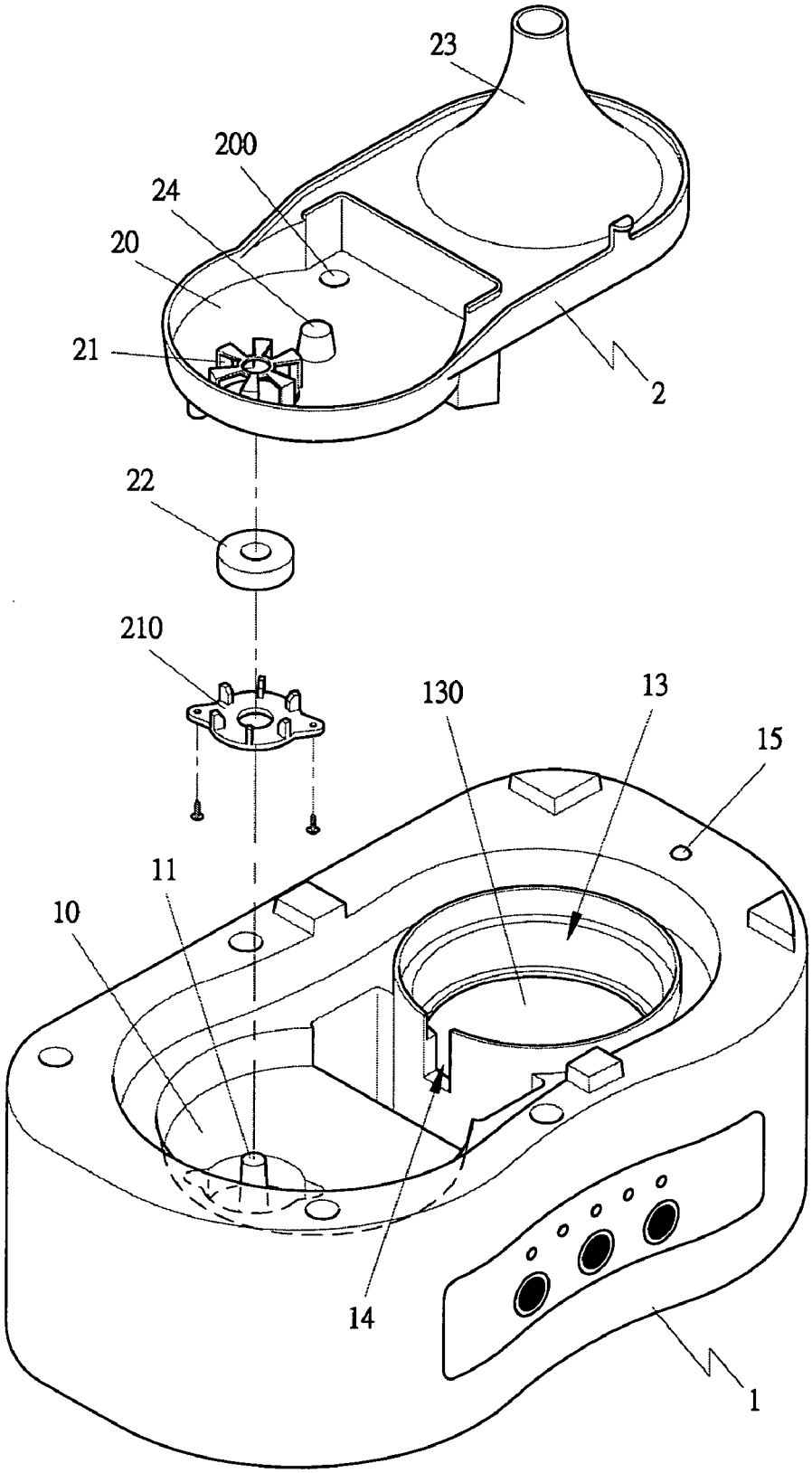
FIG. 1 is a partial exploded perspective view of a first embodiment of a humidifier with a safety device in the present invention.
Figure 2:
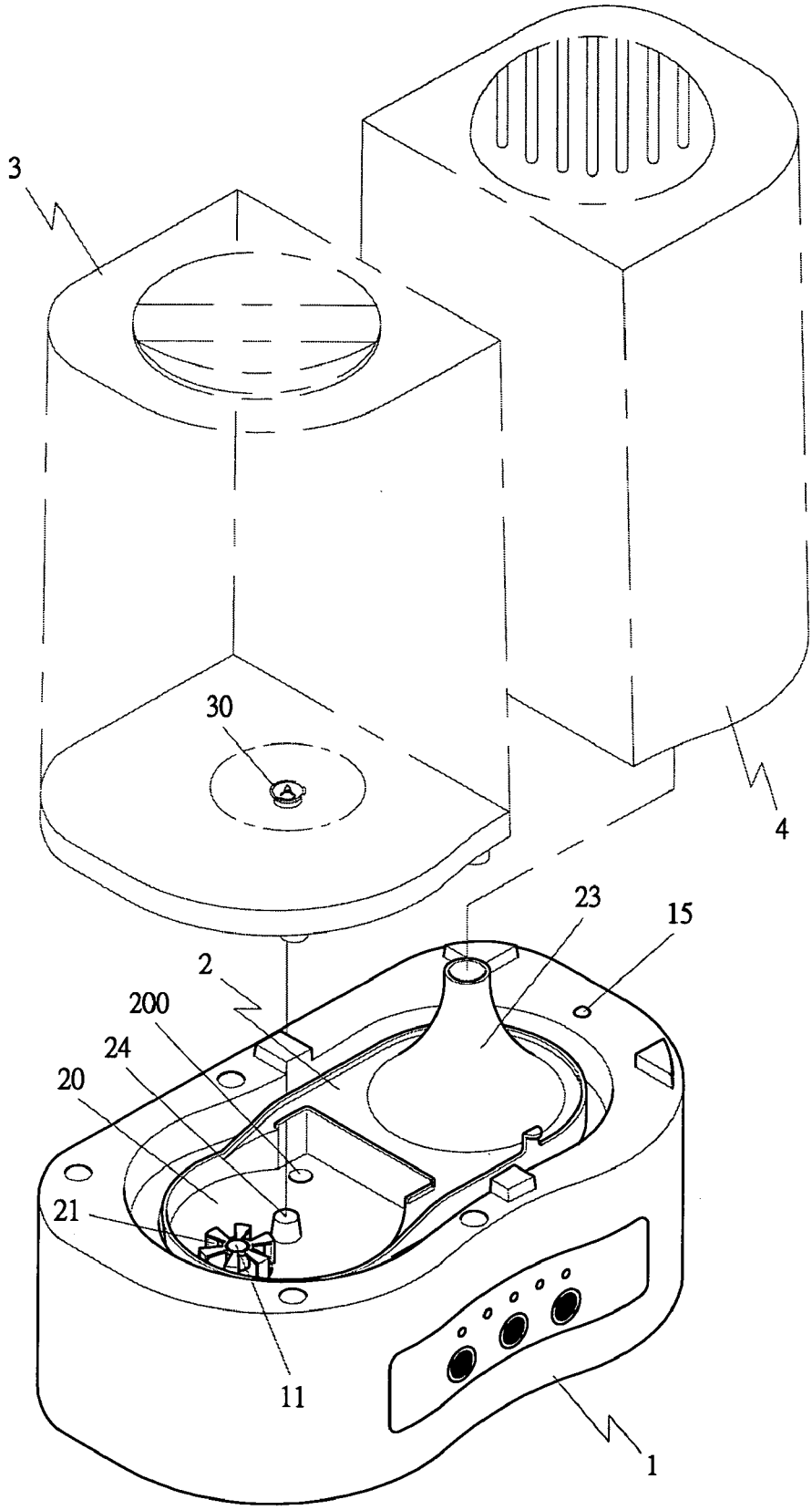
FIG. 2 is a partial perspective view of the first embodiment of a humidifier with safety device in the present invention.
Figure 3:
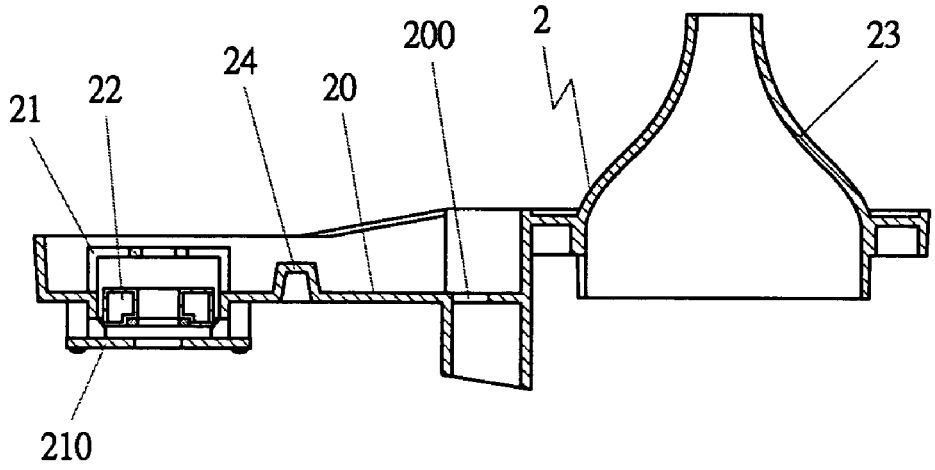
FIG. 3 is cross-sectional view of the first embodiment of a safety device for a humidifier in the present invention.
Figure 4:
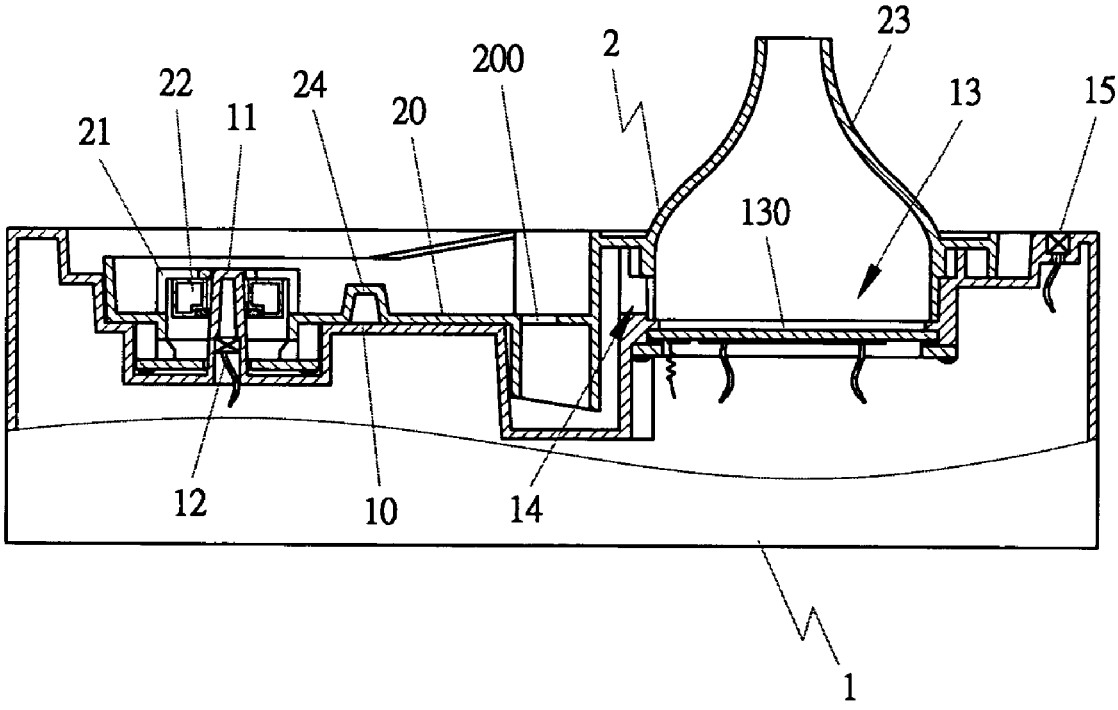
FIG. 4 is a partial cross-sectional view of the first embodiment of a safety device for a humidifier in the present invention.

A first embodiment of a safety device for a humidifier in the present invention, as shown in FIGS. 1 and 2 includes a body 1, a sensor 12, a safety device 2, positioned on a water tank 3 and a vapor tank 4 of a humidifier.

Figure 5:
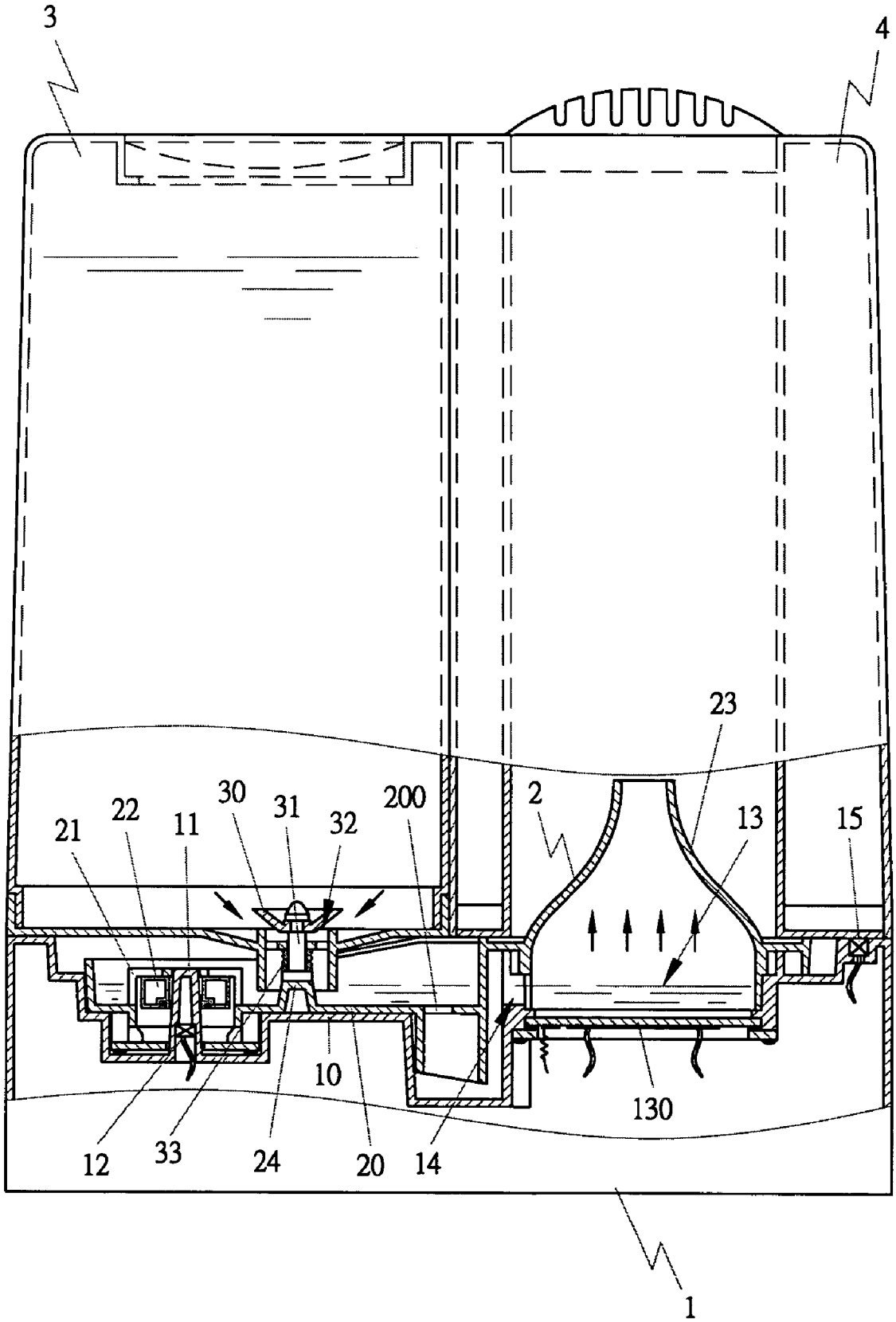
FIG. 5 is a cross-sectional view of the first embodiment of a safety device provided in a humidifier in the present invention.
Figure 6:
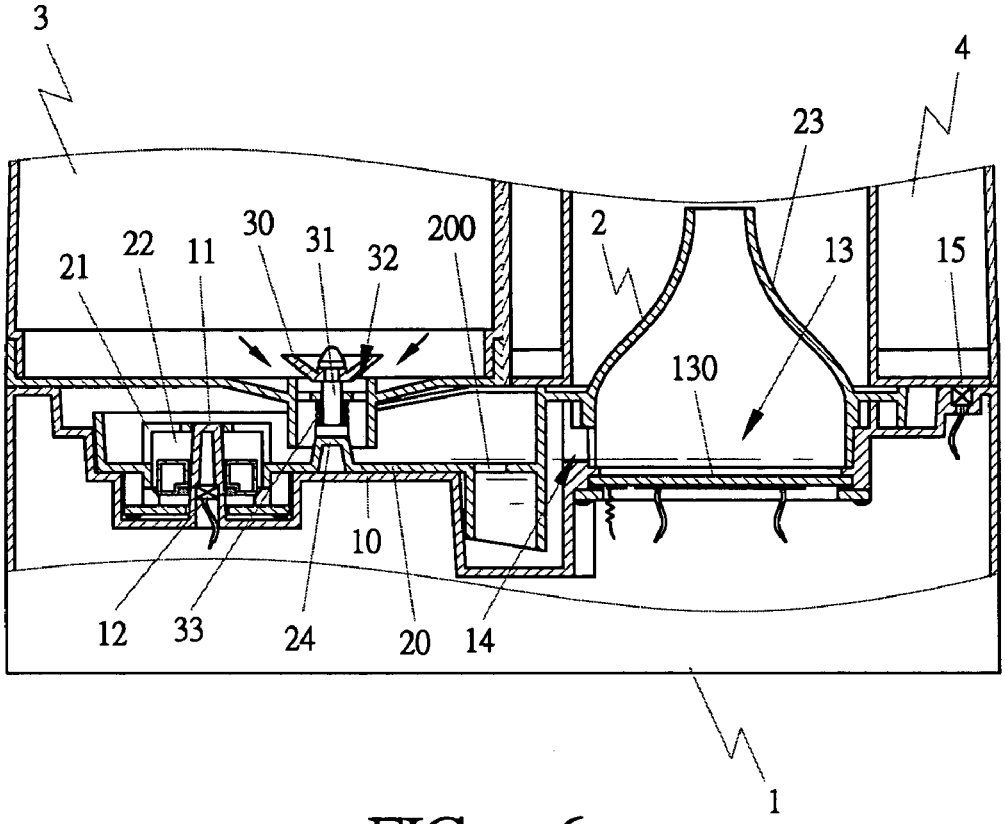
FIG. 6 is a partial cross-sectional view of the first embodiment of a safety device provided in a humidifier in the present invention.
Figure 8:
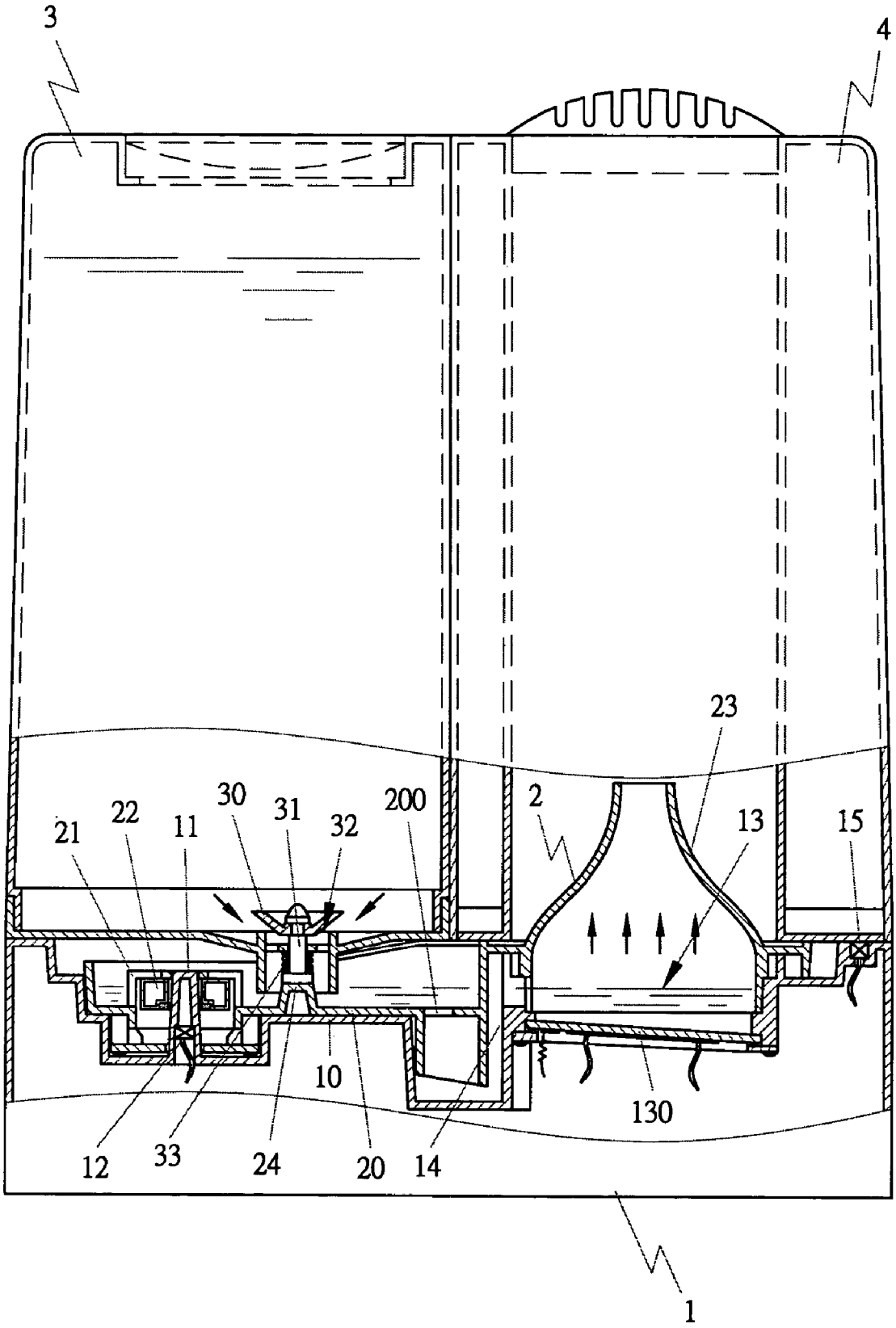

The body 1 is provided with a water chamber 10 formed in one upper side, and a post standing in the center of the water chamber 10 and having a hollow interior, and a vaporizing chamber 13 formed in the other upper side and having a bottom 130 formed flat or a little inclined as shown in FIGS. 5 and 8 and a water passage 14 is provided between the water chamber 10 and the vaporizing chamber 13. Further, a vaporizer such as a thin film heater or an oscillator is deposited in the bottom 130.

Further, the safety device 2 is positioned on the water chamber 10 and the vaporizing chamber 13, and a safety sensor 15 is disposed properly around the vaporizing chamber 13, which can be an optical sensing member, or magnetic sensing member. When the vapor tank 4 is taken off the vaporizing chamber 13, the safety sensor 15 senses it and cuts off the power immediately, keeping the humidifier completely safe.

The safety device 2 is positioned on the water chamber 10 and the vaporizing chamber 13, as shown in FIGS. 1, 2, 4, 5 and 6, provided with a small water chamber 20, a float hole 21 communicating with the small water chamber 20 for water to flow in and out of both, a float 22 contained in the float hole 21, and a limit cap 210 closing up the float hole 21. Then the float 22 is on the post 11 of the body 1, actuating the sensor 12 for taking due action. The limit cap

Figure 7:
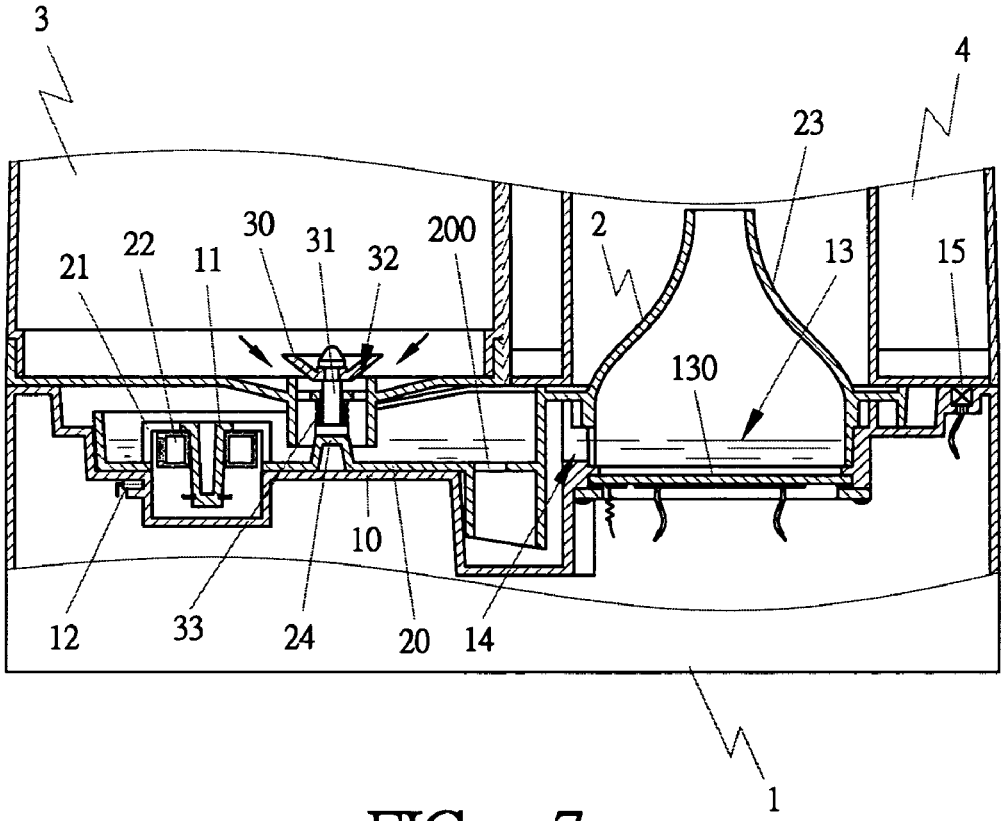
FIG. 7 is a partial cross-sectional view of a second embodiment of a safety device provided in a humidifier in the present invention; and, FIG. 8 is a cross-sectional view of a third embodiment of safety device provided in a humidifier in the present invention.

210 is positioned under the float hole 21, as shown in FIG. 1 or a helical spring lock washer fitted around the post 11 as shown FIG. 7. The small water chamber 20 is provided with a flow hole 200 for water to flow into the vaporizing chamber 13. The safety device 2 is further provided with a vapor exit base 23 for vapor to flow into the vapor tank 4, and the small water chamber 20 is further provided with an exit post 24.

The water tank 3 stores a large quantity of water, having an outlet valve 30 in the lower portion, and the outlet valve 30 has a valve rod 31 passing through the outlet 32 and having a spring 33 fitted around, with the lower end of the valve rod 31 resting on the outlet valve post 24 for controlling the water level in the small water chamber 20 at the least condition and also the water level in the vaporizing chamber 13 at the most proper condition, so the water in the vaporizing chamber 13 may quickly produce vapor.

The vapor tank 4 is positioned on the vaporizing chamber 13 for vapor produced therein to flow first therein, and then in the chamber for keeping the safety of the humidifier.

While the preferred embodiments of the invention have been described above, it will be recognized and understood that various modifications may be made therein and the appended claims are intended to cover all such modifications that may fall within the spirit and scope of the invention.

What is claimed is:

1. A humidifier comprising:

a body provided with a water chamber, a post formed in said water chamber for containing a sensor therein, said body also provided with a vaporizing chamber beside said water chamber;

a safety device positioned on said water chamber and said vaporizing chamber, said safety device provided with a small water chamber, a float hole formed in said small water chamber for a float contained therein, a limit cap closing up said float hole, said float fitting around said post of said body, said float actuating said sensor to take due action, said safety device having a vapor outlet base for vapor to flow into a vapor tank positioned above said safety device; and said safety device positioned below a water tank and said vapor tank.

2. The humidifier as claimed in claim 1, wherein said sensor is an optical electric member.

3. The humidifier as claimed in claim 1, wherein said sensor is a magnetic sensing member.

4. The humidifier as claimed in claim 1, wherein said sensor is positioned in said body.

5. The humidifier as claimed in claim 1, wherein a water passage is formed between said vaporizing chamber and said water chamber.

6. The humidifier as claimed in claim 1, wherein a safety sensor is positioned around said vaporizing chamber, and when said vapor tank is taken off the humidifier, said safety sensor senses it and cuts off the power immediately.

7. The humidifier as claimed in claim 1, wherein said limit cap of said safety device fits under the lower portion of said float hole.

8. The humidifier as claimed in claim 1, wherein said limit cap of said safety device is a helical spring lock washer.

9. The humidifier as claimed in claim 1, wherein said small water chamber is provided with a flow hole for water to flow into said vaporizing chamber.

10. The humidifier as claimed in claim 1, wherein said small water chamber of said safety device is further provided with an outlet valve post, said outlet valve past actuates an outlet valve disposed on a lower portion of said water tank, said outlet valve has a valve rod, and said valve rod passes through an outlet and has a spring fitted around, so the lower end of said valve rod rests on the outlet valve post for controlling water level in said small water chamber at the least condition as possible and also controlling said water level in said vaporizing chamber at the most proper condition, so said vaporizing chamber can quickly produce vapor.

* * * * *